US008701910B1

(12) United States Patent
Michalopoulos

(10) Patent No.: US 8,701,910 B1
(45) Date of Patent: Apr. 22, 2014

(54) WINE BOTTLE CLOSURE APPARATUS

(76) Inventor: James Michalopoulos, New Orleans, LA (US)

( * ) Notice: Subject to any disclaimer, the term of this patent is extended or adjusted under 35 U.S.C. 154(b) by 797 days.

(21) Appl. No.: 12/235,706

(22) Filed: Sep. 23, 2008

Related U.S. Application Data

(63) Continuation-in-part of application No. 11/125,876, filed on May 10, 2005, now abandoned, and a continuation-in-part of application No. 10/842,375, filed on May 10, 2004, now Pat. No. 7,395,942.

(51) Int. Cl.
*B65D 51/16* (2006.01)
*B65D 3/16* (2006.01)

(52) U.S. Cl.
USPC ..... 215/311; 215/260; 215/262; 215/228; 141/65; 141/114; 417/478

(58) Field of Classification Search
USPC ..... 215/228, 260, 262, 311, 355; 220/212, 220/231, 367.1, 802; 141/64, 65, 66, 114; 471/478 X, 480
See application file for complete search history.

(56) References Cited

U.S. PATENT DOCUMENTS

| | | | | |
|---|---|---|---|---|
| 1,788,795 | A | | 1/1931 | Hoban |
| 3,109,563 | A | | 11/1963 | Morales |
| 3,129,835 | A | | 4/1964 | Collens |
| 3,557,986 | A | * | 1/1971 | Poole, Jr. ..... 215/228 |
| 3,602,387 | A | * | 8/1971 | Patnaude et al. ..... 215/315 |
| 3,672,114 | A | | 6/1972 | Sacks |
| 3,926,348 | A | * | 12/1975 | Lutzker ..... 222/189.07 |
| 4,482,072 | A | | 11/1984 | Hankins |
| 4,684,033 | A | | 8/1987 | Marcus |
| 4,763,803 | A | | 8/1988 | Schneider |
| 4,768,665 | A | * | 9/1988 | Ballas ..... 215/228 |
| 4,889,250 | A | | 12/1989 | Beyer |
| 4,899,250 | A | | 2/1990 | Itai |
| 4,998,633 | A | | 3/1991 | Schneider |
| 5,031,785 | A | | 7/1991 | Lemme |
| 5,535,900 | A | | 7/1996 | Huang |
| 5,957,317 | A | | 9/1999 | Lee |
| 6,637,321 | B2 | | 10/2003 | Wang |
| 7,051,901 | B2 | | 5/2006 | Hickert |

* cited by examiner

*Primary Examiner* — Anthony Stashick
*Assistant Examiner* — James N Smalley
(74) *Attorney, Agent, or Firm* — Garvey, Smith, Nehrbass & North, L.L.C.; Charles C. Garvey, Jr.; Vanessa M. D'Souza

(57) ABSTRACT

An improved wine bottle closure and vacuum pump apparatus is disclosed. The apparatus provides an improved bulb structure to be used for pumping and storage purposes, the bulb remaining with a closure plug even after pumping is completed and the wine is to be stored for later consumption. The bulb structure can be collapsed in two different positions including a first position that maintains overall height of the bulb structure and a second position that enables the bulb structure to be shortened in height as an optional feature. The bulb structure provides an enlarged central section that is much larger in diameter than the lower end portion. The lower end portion provides a closure plug for fitting the opening of a wine bottle.

24 Claims, 4 Drawing Sheets

WINE BOTTLE CLOSURE APPARATUS

CROSS-REFERENCE TO RELATED APPLICATIONS

This is a continuation-in-part of U.S. patent application Ser. No. 11/125,876, filed May 10, 2005, which is incorporated herein by reference.

Priority of U.S. patent application Ser. No. 10/842,375, filed May 10, 2004 and Ser. No. 11/125,876, filed May 10, 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to wine bottle closure devices and more particularly wine bottle closure devices that employ a vacuum to remove air from the interior of the wine bottle, preserving the integrity of the wine. Even more particularly, the present invention relates to a wine bottle closure apparatus of improved configuration that employs a hollow bulb structure coupled to a specially configured plug that straps on to the top of the bottle. In one embodiment the bulb extends below the top of the bottle providing less overall height when placement on a refrigerator shelf is desired.

2. General Background of the Invention

Many devices have been patented that relate generally to the concept of pumping air from the inside of a wine bottle after it has been partially consumed. These patents discuss the use of pumps to remove air from the interior of the wine bottle and thus maintain a freshness and integrity of the wine. Other patents have issued that relate generally to squeezable bulb pumps. Examples of these patents can be seen in the following table:

TABLE 1

| U.S. PAT. NO. | TITLE | ISSUE DATE |
|---|---|---|
| 1,788,795 | Valve Controlled For Bottles Containing Carbonated Beverages | Jan. 13, 1931 |
| 3,129,835 | Food Preservation | Apr. 21, 1964 |
| 3,557,986 | Pressurizing Closure Device | Jan. 26, 1971 |
| 3,602,387 | Pump and closure Assembly | Aug. 31, 1971 |
| 4,482,072 | Pressurizing Apparatus For Partially Filled Containers | Nov. 13, 1984 |
| 4,684,033 | Device For Retarding Oxidation of Partly Consumed Bottle of Wine | Aug. 4, 1987 |
| 4,763,803 | Stopper For a Container Such as a Bottle, and a Pump Connectable Thereto For Extraction of Gaseous Medium From or Pumping in Thereof into the Container | Aug. 16, 1988 |
| 4,889,250 | Vacuum Pump and Enclosure Assembly For Beverage Container | Dec. 26, 1989 |
| 5,031,785 | Combination Vacuum/Pressure Pump and Valve Stopper for Food or Drink Containers | Jul. 16, 1991 |
| 5,957,317 | Evacuation Actuating Closure for a Container | Sep. 28, 1999 |

The Hoban U.S. Pat. No. 1,788,795 entitled "Valve Control Closure for Bottles Containing Carbonated Beverage" is designed to maintain the carbonation of a drink product contained in a bottle by preventing it from becoming "flat".

In the Collens U.S. Pat. No. 3,129,835, there is said to be value in protecting foods from bacterial deterioration using vacuum. The device disclosed in the '835 patent is said to have particular utility in the protection of coffee and numerous other items of food under vacuum. The Collens device discloses a wide mouth jar having a closure cap that employs valves. A hemispherically shaped flexible member or domed shaped member of rubber is used to squeeze air from the container.

The Poole U.S. Pat. No. 3,557,986 discloses a pressurizing closing device.

The Patnaude U.S. Pat. No. 3,602,387 discloses a pump and closure assembly that employs a bellows 20 said to be molded from a flexible plastic material. The bellows connects to a closure assembly that includes a single one way valve. An exhaust valve is provided at the top of the bellows. When the bellows is compressed, air is evacuated from the bellows. A coil spring is contained inside the bellows. The spring urges the bellows to an extended position so that as it expands. The device pumps air from the interior of a bottle to which it is attached.

The Hankins U.S. Pat. No. 4,482,072 discloses a pressurizing apparatus for partially filled containers.

The Marcus U.S. Pat. No. 4,684,033 discloses a device for retarding oxidation of a partially consumed bottle of wine. It employs a bulb and flexible flow line to pump air from the inside of the bottle.

The Schneider U.S. Pat. No. 4,763,803 discloses a stopper for a container (such as a bottle) and a pump connectable thereto for extraction of gaseous medium from or pumping into thereof into the container. The stopper and pump are separate structures that are connected together only when pumping is to occur. The stopper remains in the bottle as a closure device.

The Beyer U.S. Pat. No. 4,889,250 discloses a vacuum pump and enclosure assembly for a beverage container.

A combination vacuum/pressure pump and valve stopper for food or drink containers is disclosed in the Lemme U.S. Pat. No. 5,031,785.

The Lee U.S. Pat. No. 5,957,317 discloses an evacuation actuating closure for a container.

Some of these patents are designed to work only with wide mouth containers. Others of these devices employ complicated pumping devices that would be expensive to manufacture and prone to damage or leakage. For example, the Patnaude U.S. Pat. No. 3,602,387 employs a bellows with an internal spring. The spring would be an expensive part to install inside of a bellows. Further, the bellows provides a number of sharp corners and seams that would be prone to fatigue, cracking and eventually leakage.

The Hankins U.S. Pat. No. 4,482,072 discloses a complicated pump arrangement that would be expensive to manufacture. It would occupy a huge amount of space if remained in position upon the bottle after installation. The Marcus, '033 patent discloses a complicated pumping arrangement that would occupy an excessive amount of space if it were left attached to the bottle.

The Schneider U.S. Pat. No. 4,763,803 requires a separate pump and separate stopper arrangement that would require one or the other to be located every time the device is to be used. A similar device that employs separate pump and stopper is sold under the mark "Vacuvin".

It is known that oxygen has a deleting effect on the quality of wine over a period of time. The chemistry of wine is very complex and the constituents can be in the hundreds. Many appear as trace elements and can be directly oxidized from prolonged exposure to oxygen.

Oxygen can also affect the visual appearance of wine, creating a clouding of the wine from oxidized coloring matter within the wine. In addition to the negative deteriorative effects of oxygen on both the flavor and the coloring of the wine, oxygen changes some flavor components into acetic acid.

BRIEF SUMMARY OF THE INVENTION

The present invention solves prior art problems and shortcomings by providing a simple and convenient air/oxygen removal system for bottled wines that employs a squeeze type bulb and a plug fitted to the open mouth of a wine bottle and that can remain with the wine bottle once air and oxygen have been evacuated.

The improved pump arrangement of the present invention expels any air from within the wine bottle that could contribute to the source of flavor or essence deterioration of wine that remains within the bottle after it has been opened. The present invention provides an improved wine bottle closure apparatus that evacuates air from a wine bottle that has a neck with a bottle opening that communicates with a bottle interior.

The present invention employs an improved wine bottle closure device with a specially configured hollow bulb structure that has a bulb interior fitted to a specially configured plug.

In one embodiment, the bulb is a ball or sphere.

In one embodiment, the plug fits the top of a wine bottle with a snap fit.

In one embodiment, the bulb extends below the plug, shortening the overall height of bulb, plug and bottle. With the present invention, it is not necessary to separate the vacuum pump and plug or stopper. It can then remain with the wine bottle until the contents are consumed at a later date.

The bulb structure includes a closure plug or stopper at its lower end portion that is sized and shaped to form snap fit and a seal with a wine bottle opening. A bottle closure plug attaches to the bulb. The plug has an open ended air flow channel that communicates with the bulb interior so that air can travel from the interior of the wine bottle to the interior of the bulb during pumping. The channel provides openings at end portions of the channel.

A first check valve is mounted to the plug. The first check valve enables air flow in an upward direction from the plug air passage to the plug interior and disallowing substantial air flow in a downward direction from the bulb interior.

A second check valve is mounted to the bulb structure. Either of the check valves can be of a type that can be opened to vent the bulb interior when not pumping. Alternatively, a relief valve can be optionally mounted on the bulb wall for releasing any vacuum.

A bulb flow outlet is carried by the upper smaller diameter section and enables air to flow from the bulb interior through the second check valve to the atmosphere.

The bulb structure is preferably a resilient structure having a memory that urges the bulb wall to return to an expanded position. When the bulb is squeezed, air is thus evacuated from the bulb interior via the bulb flow outlet. The bulb has a collapsed position that subjects the bulb interior to a vacuum or sub-atmospheric pressure as the wall attempts to return to the expanded position.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
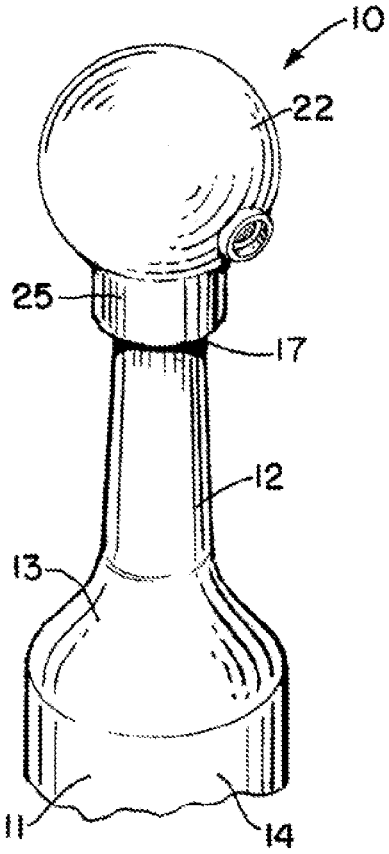
FIG. 1 is a perspective view of the preferred embodiment of the apparatus of the present invention.
Figure 2:
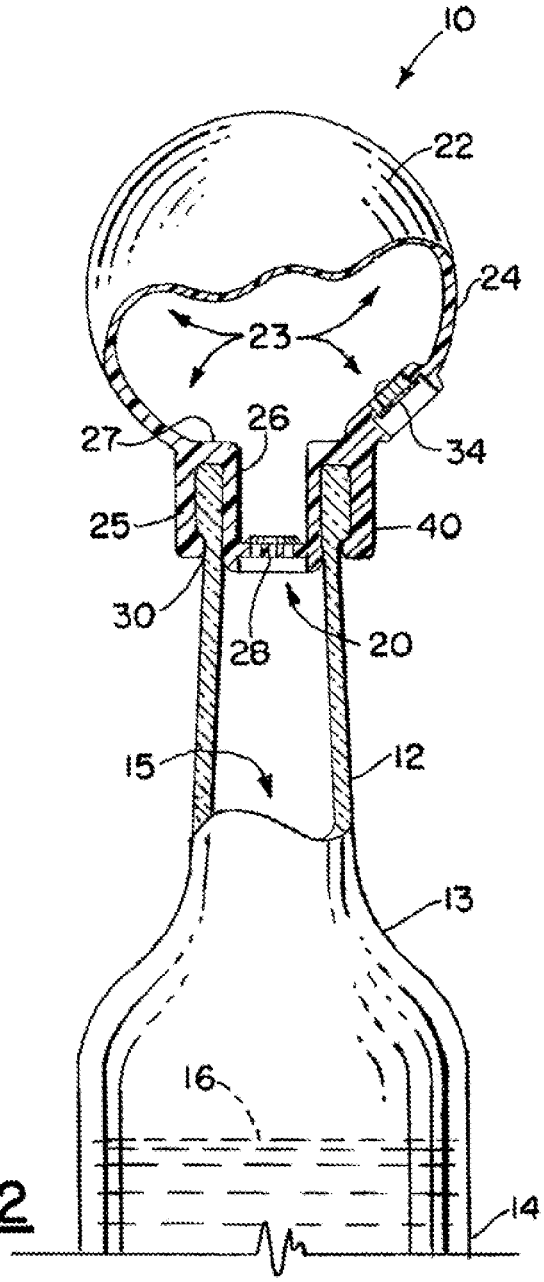
FIG. 2 is a partial, sectional elevation view of the preferred embodiment of the apparatus of the present invention.

FIGS. 1-5 show the preferred embodiment of the apparatus of the present invention, designated generally by the numeral 10. Wine bottle pump apparatus 10 is shown in use with a wine bottle 11. The wine bottle 11 has a neck 12, tapered section 13 and a larger diameter lower section 14. The bottle 11 provides an interior 15 that is filled with wine 16 to be consumed.

Bottle 11 has an upper end portion 17. Cylindrically shaped collar 18 is positioned at upper end portion 17. An annular shoulder 19 extends between cylindrically shaped collar or annular rib 18 and neck 12 as shown in FIGS. 2-5. Outlet opening 20 is provided in the bottle 11 next to upper end portion 17.

Figure 3:
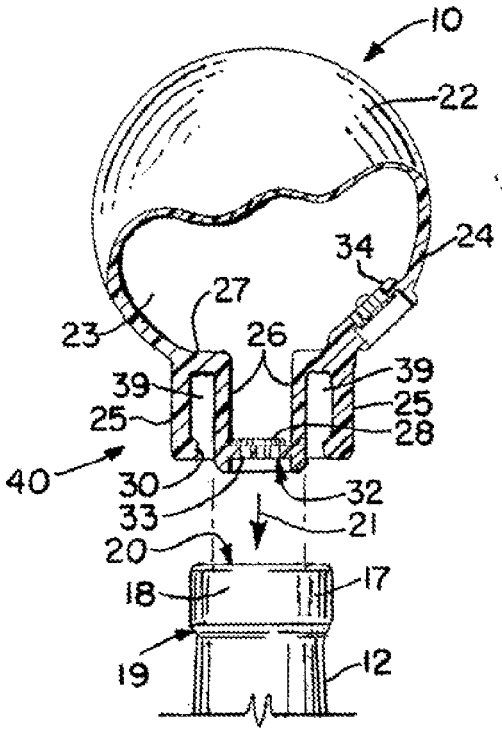
FIG. 3 is a partial, sectional elevation view of the preferred embodiment of the apparatus of the present invention.

In FIG. 3, arrow 21 schematically illustrates an assembly of bulb 22 and its plug or closure 40 to neck 12. The connection of plug or closure 40 to neck 12 at collar or rib 18 can include a snap fit or interlocking fit to cylindrically shaped collar 18 as annular shoulder registers under collar or rib 18 (see FIG. 5).

Bulb 22 provides a bulb interior 23. Bulb 22 provides a bulb wall 24 that is preferably spherically shaped as shown in FIGS. 1-5. Plug or closure 40 includes a cylindrically shaped outer wall 25, a cylindrically shaped inner wall 26, and a disk or donut shaped connecting web 27. Bulb 22 wall 24 can be attached to or be integrally formed with web 27. A pair of check valves 28, 34 are provided for pumping air/oxygen from bulb interior 23 and bottle interior 15.

Figure 4:
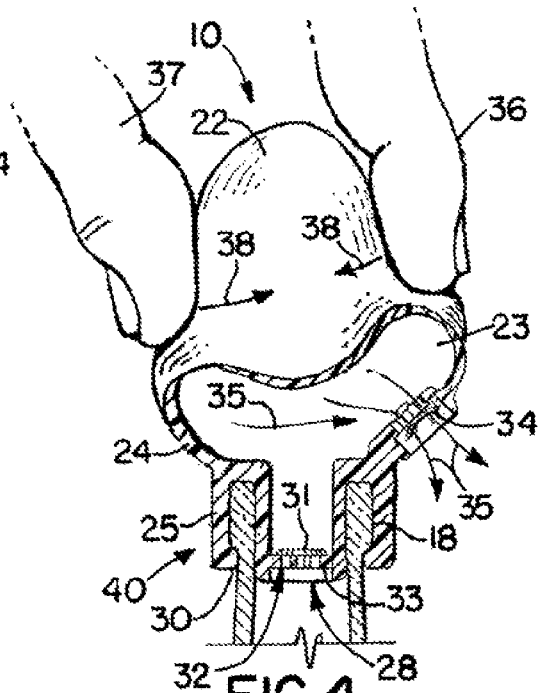
FIG. 4 is a partial, sectional elevation view of the preferred embodiment of the apparatus of the present invention shown during pumping of the bulb portion.

Valve 28 pulls air from bottle 11 interior 15 when a user releases his or her finger 36 and thumb 37 from bulb 22 after squeezing the bulb 22. In FIG. 4, when the bulb 22 is squeezed as illustrated by arrows 38, air evacuates bulb 22 interior 23 as illustrated by arrows 35 in FIG. 4. The evacuating air indicated by arrows 35 passes through check valve 34 which is mounted in wall 24 of bulb 22.

Figure 5:
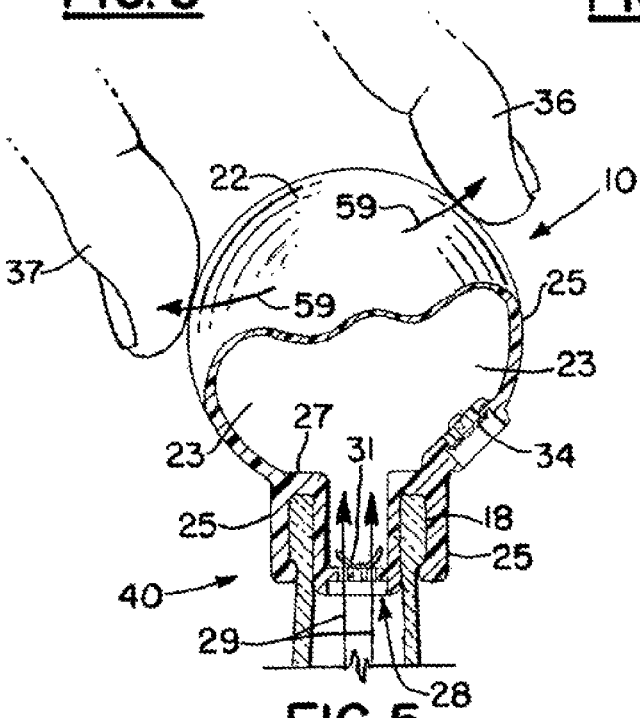
FIG. 5 is a partial, sectional elevation view of the preferred embodiment of the apparatus of the present invention shown during pumping of the bulb portion.
Figure 6:
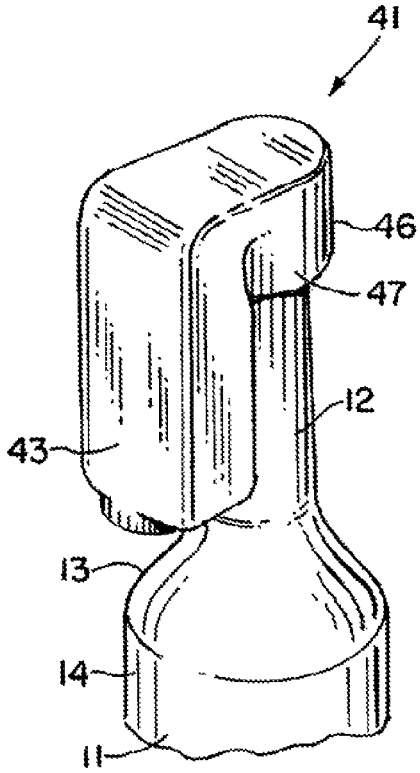
FIG. 6 is a perspective view of an alternate embodiment of the apparatus of the present invention.
Figure 7:
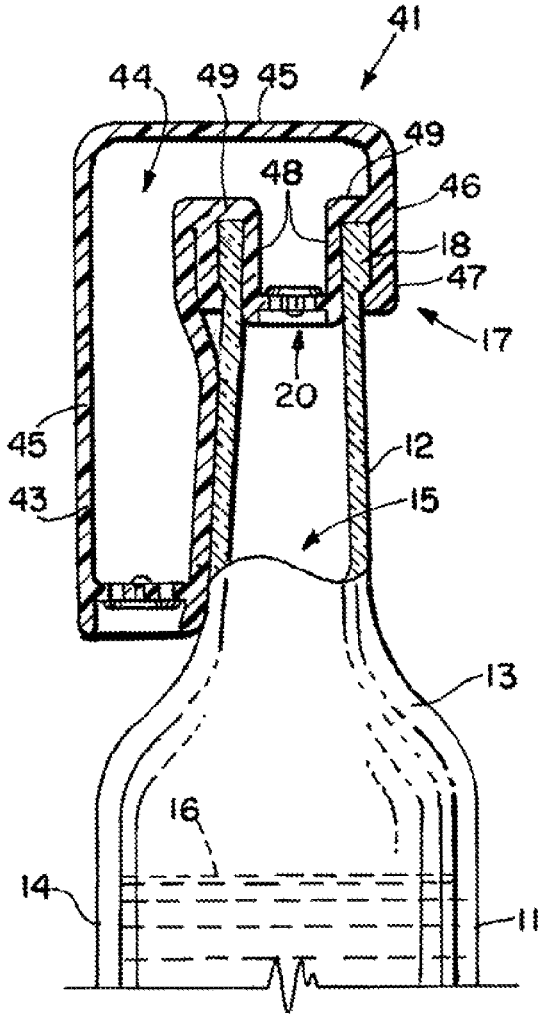
FIG. 7 is a partial sectional elevation view of the alternate embodiment of the apparatus of the present invention.
Figure 8:
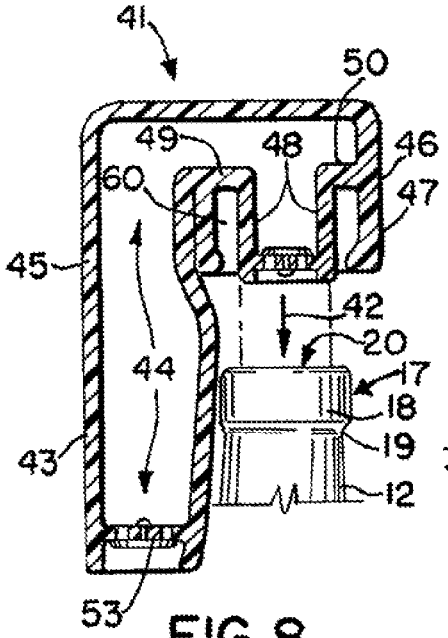
FIG. 8 is a partial sectional elevation view of the alternate embodiment of the apparatus of the present invention.

When the user releases his or her finger 36 and thumb as illustrated in FIG. 5, the bulb 22 can have a memory so that it expands to its original spherical shape, illustrated by arrows 59 in FIG. 5. This action creates a vacuum within bulb 22 interior 23. Air contained within bottle 11 interior 15 travels through check valve 28 as illustrated by arrows 29 in FIG. 5.

An annular shoulder 30 is provided at the lower end portion of cylindrically shaped outer wall 25 as shown in FIG. 3. When applying bulb 22 and its closure or plug 40 to bottle 11, cylindrically shaped outer wall 25 deforms slightly so that cylindrically shaped collar 18 can fit into and occupy annular socket 39. Socket 39 is in between cylindrically shaped outer wall 25 and cylindrically shaped inner wall 26. As cylindrically shaped collar 18 enters annular socket 39, upper end 17 of bottle 11 engages connecting web 27 which acts as a stop to limit further movement of bottle 11 into socket 39. Simultaneously, annular shoulder 30 snaps or interlocks into position next to annular shoulder 19 as shown in FIGS. 3-5.

The bulb 22 and plug/closure 40 can be of a resilient material such as rubber, polyurethane, polypropylene, or other plastic or polymeric material or the like. In the position of FIGS. 4 and 5, the annular shoulder 30 is a retainer that holds the plug or closure 40 in position by engaging annular shoulder 19 of bottle 11. Each of the check valves 28, 34 can provide a valving member or disc 31 that opens and closes. Each of the check valves 28, 34 can include a valve body 33 having an opening or openings 32 therethrough. A closed position of check valve 28 is seen in FIG. 4. An open position of check valve 28 is seen in FIG. 5.

Figure 9:
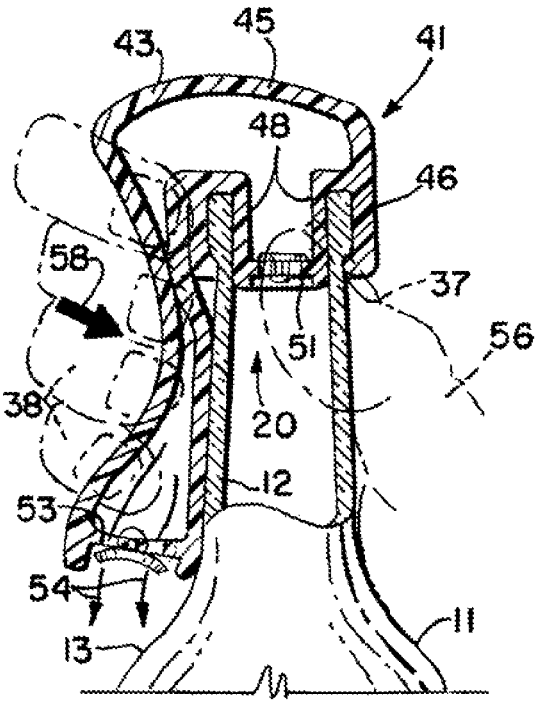
FIG. 9 is a partial, sectional elevation view of the alternate embodiment of the apparatus of the present invention shown during pumping of the bulb portion.
Figure 10:
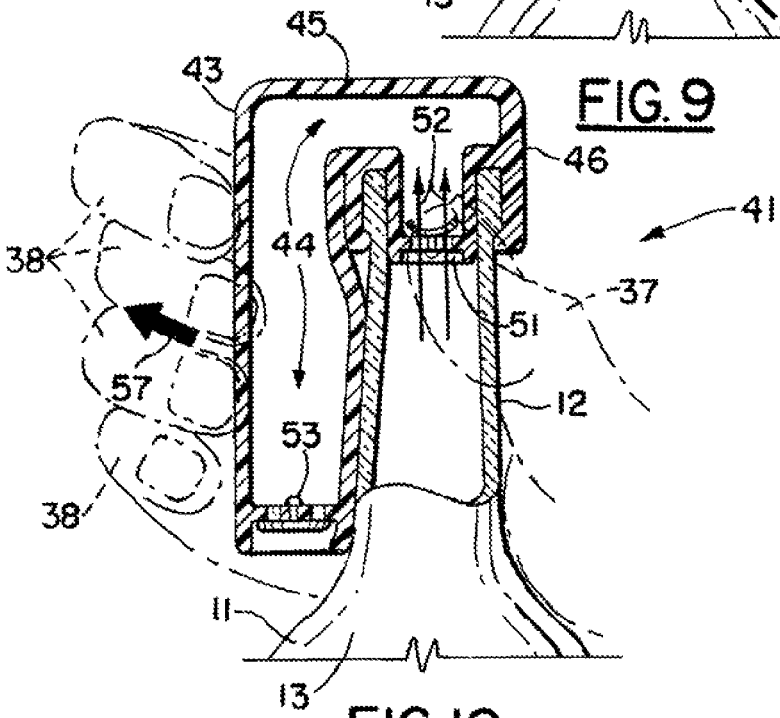
FIG. 10 is a partial, sectional elevation view of the alternate embodiment of the apparatus of the present invention shown during pumping of the bulb portion.

FIGS. 6-10 show an alternate embodiment of the apparatus of the present invention, designated generally by the numeral 41. Wine bottle pump apparatus 41 can be affixed to bottle neck 12 and cylindrically shaped collar 18 in the same fashion as the embodiment of FIGS. 1-5. Plug or closure 46 fits bottle 11 neck 12 as shown by arrow 42 in FIG. 8, wherein collar or rib 18 occupies socket 60. The embodiment of FIGS. 6-10 provides a bulb 43 that extends along the neck 12 as shown in FIGS. 6-10. This construction enables a user's hand 56 to extend around both bottle neck 12 and bulb 43 when pumping as shown in FIGS. 9 and 10. A user would thus grab the combination of bottle neck 12 and bulb 43 when air is to be pumped from bottle 11 interior 15. A beginning position is shown in FIG. 10. In FIG. 9, a user's hand 56 is shown gripping the combination of neck 12 and bulb 43, and the hand 56 compressing bulb 43.

Bulb 43 provides an interior 44 and a bulb wall 45. A plug or closure 46 is of similar construction to the preferred embodiment of FIGS. 1-5. The plug or closure 46 provides a cylindrically shaped outer wall 47 and a cylindrically shaped inner wall 48. Connecting web 49 spans between the upper end portions of the cylindrically shaped outer wall 47 and the cylindrically shaped inner wall 48 as shown in FIGS. 7-10.

As with the preferred embodiment, the periphery 50 of connecting web 49 can be integrally connected to bulb 43. A pair of check valves 51, 53 are provided. The check valves 51, 53 can be of the same construction and operation as the check valve 28. Arrow 52 in FIG. 10 illustrates an evacuation of air from bottle 12 interior 15 when a user releases pressure on bulb 43 as illustrated by the arrow 57 in FIG. 10. In FIG. 9, arrows 54 illustrate the discharge of air from bulb 43 interior 44 when a user compresses the bulb 43 as illustrated by arrow 58 in FIG. 9.

The following is a list of parts and materials suitable for use in the present invention:

PARTS LIST:

| Part Number | Description |
|---|---|
| 10 | wine bottle closure apparatus |
| 11 | bottle |
| 12 | neck |
| 13 | tapered section |
| 14 | larger diameter section |
| 15 | interior |
| 16 | wine |
| 17 | upper end portion |
| 18 | cylindrically shaped collar/ annular rib |
| 19 | annular shoulder |
| 20 | outlet opening |
| 21 | arrow |
| 22 | bulb |
| 23 | bulb interior |
| 24 | bulb wall |
| 25 | cylindrically shaped outer wall |
| 26 | cylindrically shaped inner wall |
| 27 | connecting web |
| 28 | check valve |
| 29 | arrow |
| 30 | annular shoulder |
| 31 | valving member/disk |
| 32 | opening |
| 33 | valve body |
| 34 | check valve |
| 35 | arrow |
| 36 | user's finger |
| 37 | user's thumb |
| 38 | arrow |
| 39 | annular socket |
| 40 | plug/closure |
| 41 | wine bottle pump |
| 42 | arrow |
| 43 | bulb |
| 44 | bulb interior |
| 45 | bulb wall |
| 46 | plug/closure |
| 47 | cylindrically shaped outer wall |
| 48 | cylindrically shaped inner wall |
| 49 | connecting web |
| 50 | periphery |
| 51 | check valve |
| 52 | arrow |
| 53 | check valve |
| 54 | arrow |
| 55 | arrow |
| 56 | user's hand |
| 57 | arrow |
| 58 | arrow |
| 59 | arrow |
| 60 | socket |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A wine bottle closure and vacuum apparatus, comprising:

a) a wine bottle having a larger diameter lower section, a smaller diameter neck, and a tapered portion below the neck, the neck surrounded by an annular rib and a bottle opening that communicates with a bottle interior, comprising:

b) a hollow bulb structure that has a bulb wall surrounding a bulb interior, the bulb structure extending downwardly from the bottle opening and along the bottle neck;

c) a bottle closure plug that is sized and shaped to form a seal with bottle opening, the plug attached to the bulb, the closure plug having an open ended air flow channel that communicates with the bulb interior and the bottle interior, closure plug comprising a cylindrically shaped inner section that is configured to occupy the bottle neck below the bottle opening and an outer generally cylindrically shaped section that extends around the bottle rib;

d) a connection between the bulb structure and closure plug being a one hundred eighty degree bend;

e) a first check valve mounted to an assembly of bulb structure and closure plug at a position that is next to the closure plug, the first check valve enabling air flow in an upward direction from the plug air channel to the bulb interior and disallowing substantial air flow in a direction from the bulb interior to the bottle interior;

f) a second check valve mounted to the bulb wall below said bend;

g) wherein the second check valve enables flow from between the bulb interior to the exterior of the bulb;

h) the bulb structure being a resilient structure having a memory so that when the bulb is squeezed, air is evacuated from the bulb interior via the second check valve and the bulb has a collapsed position that subjects the bulb interior to subatmospheric pressure;

i) wherein the bulb includes a straight section that extends along the neck and below the closure plug and the one hundred eighty degree bend, the straight section terminating at a bulb lower end that is next to the tapered portion, thus enabling a user to place multiple fingers of his or her hand on the combination of neck and straight section of the bulb in order to squeeze the straight section of the bulb when pumping the bulb; and j) wherein the straight section of the bulb is in close contact with the neck below the bend and above the tapered portion.

2. The wine bottle closure apparatus of claim 1 further comprising an annular shoulder on the closure plug that fits under the annular rib.

3. The wine bottle closure apparatus of claim 1 wherein the bulb contacts the bottle neck over a majority of the distance between the bend and the tapered portion of the bottle.

4. The wine bottle closure apparatus of claim 1 wherein the bulb extends downwardly from the closure plug.

5. The wine bottle closure apparatus of claim 1 wherein the first check valve is contained in the closure plug.

6. The wine bottle closure apparatus of claim 4 wherein the first check valve is contained in the closure plug.

7. The wine bottle closure apparatus of claim 1 wherein the bulb structure has a bulb lower end next to the bottle neck and the second check valve is in said bulb lower end.

8. The wine bottle closure apparatus of claim 1 wherein the second check valve is on a lower half of the bulb.

9. A wine bottle closure and vacuum apparatus, comprising:

a) a wine bottle having a tapered portion, a neck having an exterior annular rib and an interior bottle opening that communicates with a bottle interior, comprising:

b) a hollow bulb structure that has a bulb wall and a bulb interior, a portion of said bulb structure extending downwardly in contact with the neck in between the bottle neck and the tapered portion, said bulb structure sized and shaped to enable a user to simultaneously grip the bottle neck and the bulb;

c) a bottle closure plug having an inner portion that is sized and shaped to form a seal with the bottle opening and an outer portion that engages the bottle neck at the annular rib, said closure plug having an air flow channel for communicating between the bulb interior and the wine bottle interior, the channel providing opposed openings;

d) the bulb structure including a one hundred eighty degree bend section that joins the bulb structure to the closure plug, the bulb structure having a bulb straight section below the bend that is vertically oriented, said straight section having a lower end;

e) a first check valve mounted to the inner portion of the closure plug, the first check valve enabling air flow in an upward direction from the plug air flow channel to the bulb interior and disallowing substantial air flow in a downward direction from the bulb interior to the plug lower opening;

f) a second check valve mounted to the bulb wall at said lower end of said bulb straight section;

g) wherein the second check valve enables flow between the bulb interior and the bulb exterior;

h) the bulb structure being a resilient structure having a memory so that when the bulb is squeezed, air is evacuated from the bulb interior; and i) wherein the bulb straight section is closely spaced to the neck and that extends along the neck from below the closure plug to a position next to the tapered portion, thus enabling a user to squeeze the combination of bulb straight section and bottle neck along the neck when multiple of the user's fingers are gripping the combination of bulb straight section and neck between the bend section and second check valve.

10. The wine bottle closure apparatus of claim 9 wherein the bulb is a sphere.

11. The wine bottle closure apparatus of claim 9 wherein the bulb inner and outer portion of the closure plug are joined with a web.

12. The wine bottle closure apparatus of claim 9 wherein the closure plug is integrally joined to the bulb.

13. The wine bottle closure apparatus of claim 9 wherein the first check valve is contained in the closure plug.

14. The wine bottle closure apparatus of claim 12 wherein the first check valve is contained in the closure plug.

15. The wine bottle closure apparatus of claim 9 wherein the bulb structure includes a flexible side wall.

16. A wine bottle closure and vacuum apparatus, comprising:

a) a wine bottle having a larger diameter lower section, a smaller diameter neck, and a tapered portion below the neck and above the lower section, and a bottle opening that communicates with a bottle interior;

b) a hollow bulb structure that has a bulb wall surrounding a bulb interior, the bulb structure having a bend section and vertical straight section extending downwardly from the bend section along the bottle neck;

c) a bottle closure plug that is sized and shaped to form a seal with bottle opening, the closure plug attached to the bulb, the closure plug having an open ended air flow channel that communicates with the bulb interior and the bottle interior, closure plug comprising a cylindrically shaped inner section that is configured to occupy the bottle neck below the bottle opening and an outer generally cylindrically shaped section that extends around the bottle rib;

d) a connection between the bulb straight section and the closure plug being said bend section;

e) a first check valve mounted to an assembly of bulb structure and closure plug at a position that is next to the closure plug, the first check valve enabling air flow in an upward direction from the plug air channel to the bulb interior and disallowing substantial air flow in a direction from the bulb interior to the bottle interior;

f) a second check valve mounted to the bulb wall at the bottom of the straight section;

g) wherein the second check valve enables flow from between the bulb interior to the exterior of the bulb;

h) the bulb structure being a resilient structure having a memory so that when the bulb is squeezed to define a first, compression position, air is evacuated from the bulb interior via the second check valve wherein the bulb has a second collapsed position that subjects the bulb interior to subatmospheric pressure;

i) wherein the bulb structure straight section is generally vertically positioned and terminates at a lower end that is next to the tapered portion of the bottle, thus enabling a user to place multiple fingers of his or her hand on the combination of neck and straight section of the bulb in order to squeeze the straight section of the bulb to the first compression position when pumping the bulb; and j) wherein the straight section of the bulb is in close contact with the neck below the bend and above the tapered portion in the first compression position.

17. The apparatus of claim 16 wherein the second check valve is mounted to a transverse panel of the bulb structure.

18. The apparatus of claim 16 wherein the bulb structure includes an annular wall that surrounds the bottle neck at the bottle opening.

19. The apparatus of claim 18 wherein the bend section extends outwardly of the annular wall.

20. The apparatus of claim 18 wherein the straight section contacts the neck over a majority of the distance between the annular wall and the bottle tapered portion in the compressed position.

21. The apparatus of claim 18 wherein the second check valve is spaced below the annular wall.

22. The apparatus of claim 18 wherein the straight section is below the first check valve.

23. The apparatus of claim 18 wherein a majority of the straight section is below the first check valve.

24. The apparatus of claim 16 wherein a majority of the straight section is in between the first and second check valves.

* * * * *